United States Patent [19]

Candor

[11] 3,992,793

[45] *Nov. 23, 1976

[54] FRAME CONSTRUCTION FOR A PLURAL PAGE DOCUMENT

[76] Inventor: James T. Candor, 5440 Cynthia Lane, Dayton, Ohio 45429

[ * ] Notice: The portion of the term of this patent subsequent to Apr. 30, 1991, has been disclaimed.

[22] Filed: Nov. 4, 1975

[21] Appl. No.: 628,662

Related U.S. Application Data

[60] Division of Ser. No. 460,745, April 15, 1974, Pat. No. 3,927,483, which is a division of Ser. No. 336,989, March 1, 1973, Pat. No. 3,807,071, which is a continuation-in-part of Ser. No. 271,925, July 14, 1972, abandoned.

[52] U.S. Cl. ..... 40/102; 40/152; 40/104.17

[51] Int. Cl.[2] ..... G09F 1/12

[58] Field of Search 40/102, 104.02, 104.17–104.19, 40/152, 159, 10 R, 158, 124, 124.2; 283/15 R, 15 B

[56] References Cited

UNITED STATES PATENTS

| | | | |
|---|---|---|---|
| 1,626,150 | 4/1927 | Parda | 40/104.18 |
| 2,649,799 | 8/1953 | Spertus | 40/152 |
| 2,795,067 | 6/1957 | Walker | 40/104.18 |
| 3,589,049 | 6/1971 | Cornelius | 40/152 |
| 3,807,071 | 4/1974 | Candor | 40/104.02 |
| 3,927,483 | 12/1975 | Candor | 40/102 |

FOREIGN PATENTS OR APPLICATIONS

| | | | |
|---|---|---|---|
| 1,081,233 | 6/1954 | France | 281/15 B |
| 37,532 | 7/1930 | France | 40/152 |
| 226,890 | 12/1943 | Switzerland | 40/152 |

*Primary Examiner*—Hugh R. Chamblee
*Assistant Examiner*—John H. Wolff
*Attorney, Agent, or Firm*—Candor, Candor & Tassone

[57] ABSTRACT

A frame construction for a plural page document and having framing means defining a window area bordered thereby. Carrier means carried by said framing means, said carrier means carrying the pages of the document and supporting the same in hinged stacked relation in the window area to permit the pages to be subsequently fanned at the window area for individual viewing thereof.

10 Claims, 25 Drawing Figures

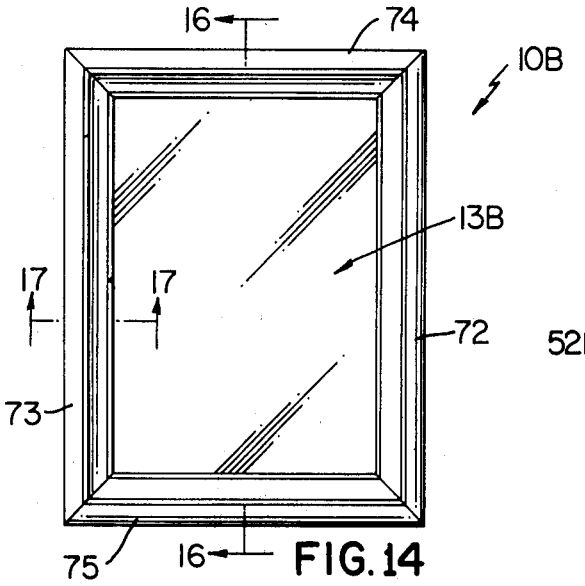
FIG. 14
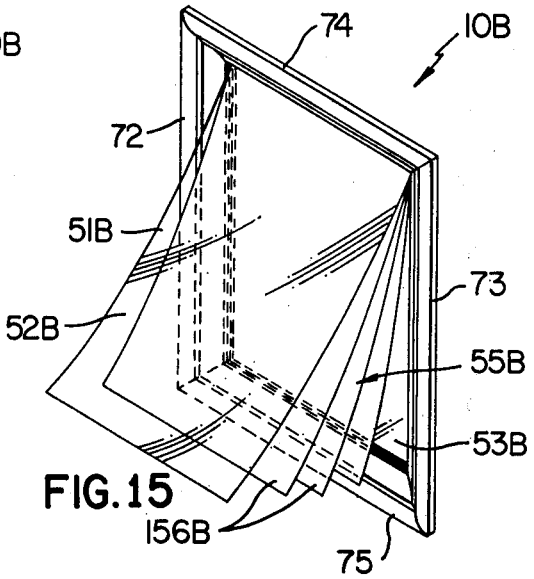
FIG. 15
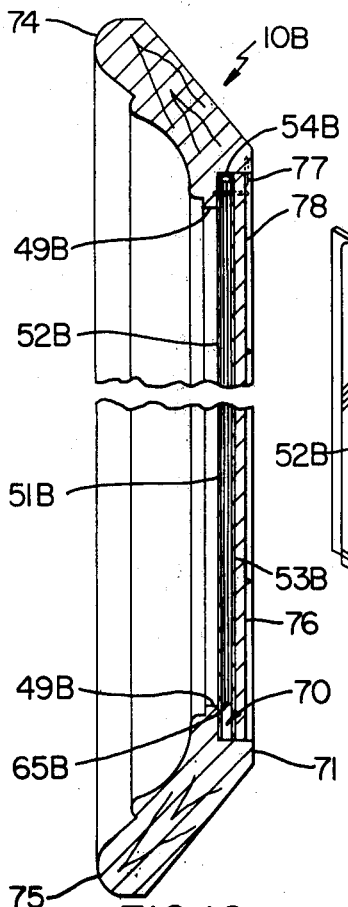
FIG. 16
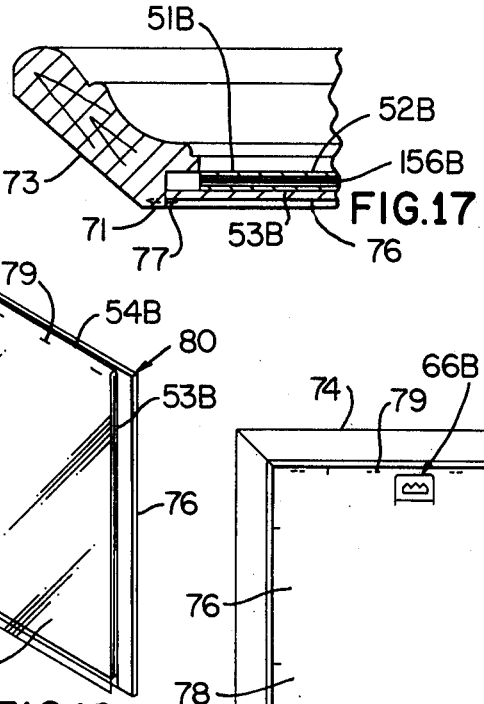
FIG. 17
FIG. 19
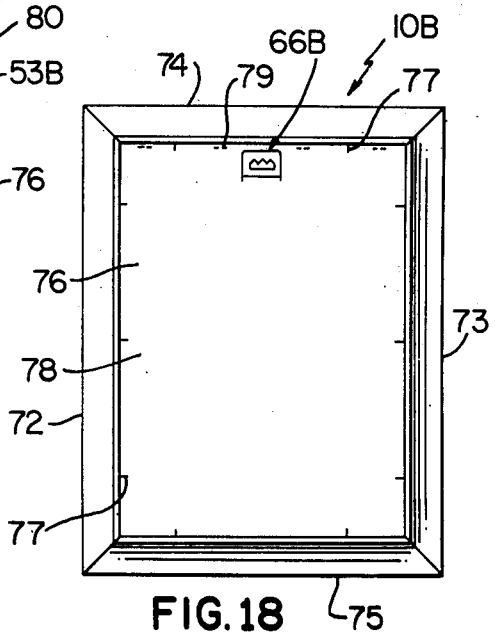
FIG. 18

FRAME CONSTRUCTION FOR A PLURAL PAGE DOCUMENT

This application is a divisional patent application of its co-pending parent application Ser. No. 460,745, filed Apr. 15, 1974, now U.S. Pat. No. 3,927,483, which in turn, is a divisional patent application of its co-pending patent application Ser. No. 336,989, filed Mar. 1, 1973, now U.S. Pat. No. 3,807,071, which, in turn, is a Continuation-In-Part application of its co-pending parent patent application Ser. No. 271,925, filed July 14, 1972, now abandoned.

This invention relates to a frame construction that can be utilized for framing a plural page document, the frame construction being adapted to be mounted on a wall, desk, or other desired supporting structure.

It is well known that frame constructions have been provided for pictures and the like wherein the item beng framed is disposed in a window area behind a glass panel or is merely exposed at the window area. In any event, the item being framed is held stationary in the frame.

However, according to the teachings of this invention, a frame construction is provided for a plural page document wherein each page of the document can be individually viewed in the frame construction by the viewer merely fanning out the pages thereof which are normally held in a hinged stacked relation in the window area of the frame construction.

In particular, one embodiment of this invention provides a back support for supporting the frame construction in an upright position on a wall, desk, or other supporting structure as desired. Framing means are disposed adjacent the outer periphery of the back support to define a window area therewithin. Carrier means is hinged to the framing means to serially carry the pages of the document to support the same in stacked relation in the window area and yet permit the pages to be subsequently fanned by a viewer for individual viewing thereof. If desired, the carrier means can be held in the window area by the framing means so as to only expose the top page of he document until the viewer decides to fan out the carrier means to view the other pages of the document.

Accordingly, it is an object of this invention to provide an improved frame construction having one or more of the novel features set forth above or hereinafter shown or described.

Other objects, uses and advantages of this invention are apparent from a reading of this description which proceeds with reference to the accompanying drawings forming a part thereof and wherein:

FIG. 14 is a front view of another frame construction of this invention.

FIG. 15 is a side perspective view of the frame construction of FIG. 14 illustrating the manner of fanning out the various pages of the plural page document thereof for individual viewing thereof.

FIG. 16 is an enlarged, cross-sectional view taken on line 16—16 of FIG. 14.

FIG. 17 is an enlarged, fragmentary, cross-sectional view taken on line 17—17 of FIG. 14.

FIG. 18 is a rear view of the frame construction of FIG. 14.

FIG. 19 is a perspective view of the carrier member and plural page document adapted to be utilized with the frame construction of FIG. 14 and be removed therefrom.

Figure 1:
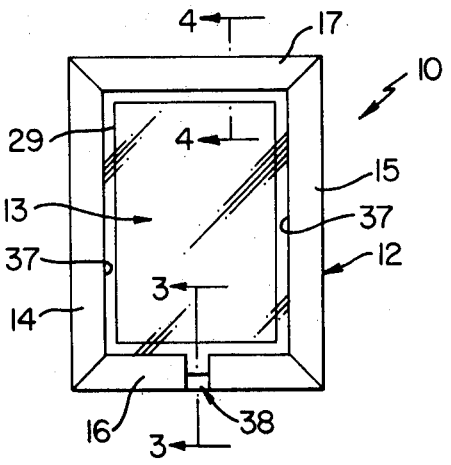
FIG. 1 is a front view of the improved frame construction of this invention.

While the various features of this invention are hereinafter described and illustrated as being particularly adapted for framing a plural page document, it is to be understood that the various features of this invention can be utilized singly or in any combination thereof to provide framing means for single page documents or other structure as desired.

Therefore, this invention is not to be limited to only the embodiment illustrated in the drawings, because the drawings are merely utilized to illustrate one of the wide variety of uses of this invention.

Figure 2:
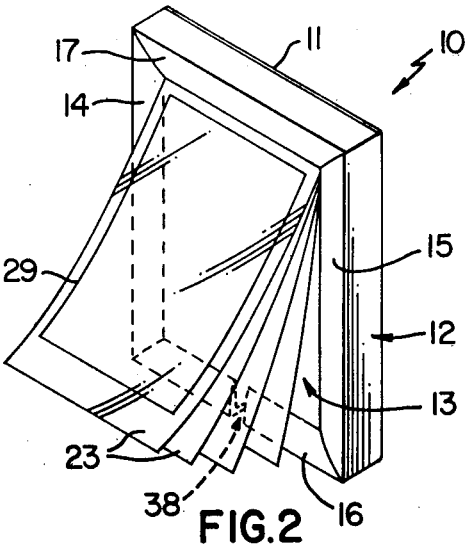
FIG. 2 is a side perspective view of the frame construction of FIG. 1 illustrating the manner of fanning out the various pages of a plural page document for individual viewing thereof.

Referring now to FIGS. 1 and 2, the improved frame construction of this invention is generally indicated by the reference numeral 10 and comprises a flat back support 11 formed in a rectangular configuration and having framing means 12 disposed about the other periphery to define a substantially rectangular window area 13 therewith.

Figure 6:
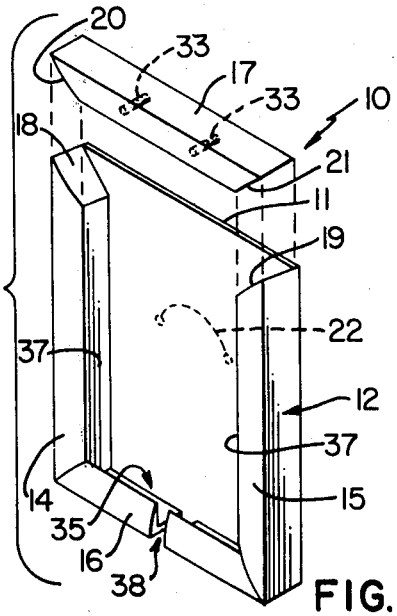
FIG. 6 is an exploded, perspective view illustrating other parts of the frame construction of FIG. 1.

If desired, the frame construction 10 can be formed of molded plastic material and can be in the configuration illustrated in FIG. 6 wherein the flat back support 11 is integral with opposed side parts 14 and 15 of the framing means 12 as well as integral with a lower framing part 16 disposed at the bottom of the support 11. However, the upper part 17 of the framing means 12 is formed separate from the backing member 11 and is so constructed and arranged that the same is adapted to cooperate with the side framing parts 14 and 15 at the upper beveled edges 18 and 19 thereof to complete the frame about the window area 13 in the manner illustrated in FIG. 1 when the part 17 is assembled thereon.

If desired, the opposed ends 20 and 21 of the detachable framing part 17 and the upper ends 18 and 19 of the integral framing parts 14 and 15 can be so beveled and slanted that even though the frame construction 10 is mounted against a wall by a suitable wire hanging means 22 disposed on the back of the back support 11 so that the frame construction 10 is tilted outwardly at the top thereof adjacent the wall in the normal picture framing manner, the part 17 will fully nest within the beveled parts 18 and 19 of the integral framing members 14 and 15 so as not to fall therefrom. Also, if desired, the part 17 can be snap fitted to the side parts 14 and 15 to be more firmly secured thereto while still being readily detached therefrom.

Figure 5:
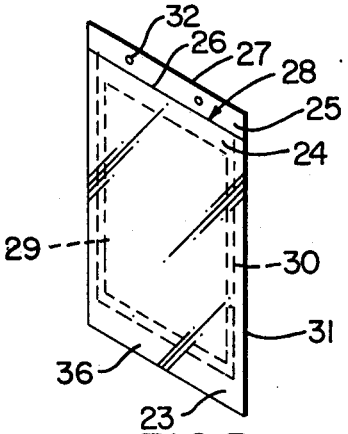
FIG. 5 is a perspective view of one of the carrier members utilized in the frame construction of FIG. 1.

The frame construction 10 includes a plurality of carrier members 23 each being formed of transparent material and comprising two sheets of material 24 and 25 secured together about the outer periphery thereof except at the tops 26 and 27 thereof to define a pocket 28 therebetween which is adapted to receive at least one page 29 of a plural page document in the manner fully illustrated in FIG. 5. If desired, the sheets 24 and 25 can be so secured together, such as by heat sealing or the like, to define an inner securing line means 30 to fully center the page 29 within the pocket 28 so that the same is properly centered relative to the border edge 31 of the carrier member 23.

Figure 4:
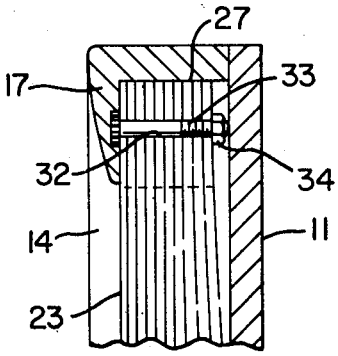
FIG. 4 is an enlarged, fragmentary, cross-sectional view taken on line 4—4 of FIG. 1.

The taller sheet 25 of each carrier member 23 has a plurality of openings 32 passing therethrough so as to be adapted to be received on threaded fastening members 33 carried by the removable framing part 17 in the manner illustrated in FIG. 4 whereby a plurality of carrier members 23 can be disposed on the fastening members 33 in serial stacked relation. Thereafter, nuts 34 can be utilized to secure the carrier members 23 in place.

Figure 3:
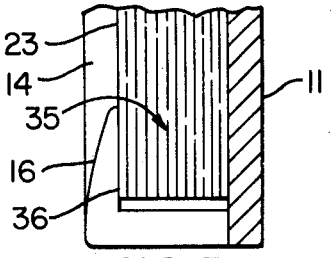
FIG. 3 is an enlarged, fragmentary, cross-sectional view taken on line 3—3 of FIG. 1.

After the pockets 28 of the carrier members 23 have been filled with the desired pages 29 of the desired document, and the carrier members 23 have been stacked on the pins 33 of the framing part 17 in the desired order, the carrier members 23 are fastened to the framing part 17 by the nuts 34 in the manner illustrated in FIG. 4. The part 17 is then placed on the ends 18 and 19 of the framing parts 14 and 15 of the frame construction 10 in the manner illustrated in FIG. 1. It can be seen that the length of the carrier members 23 is such that the same are adapted to be received in a recess means 35 formed in the bottom framing part 16 in the manner illustrated in FIG. 3 to hold the lower ends 36 of the carrier members 23 in stacked relation within the window area 13 of the frame construction 10. The width of each carrier member 23 is such that the same is adapted to be disposed completely within the inner flat sides 37 of the side framing members 14 and 15 so that when viewing the frame construction 10 a front view in the manner illustrated in FIG. 1, only the front page 29 of the plural page document is in view and the same is fully centered within the framing means 12 so as to give the appearance of being a single sheet picture.

However, when a person desires to view the pages 29 of the document in the frame construction 10, that person can reach a finger within a slot means 38 formed in the lower framing part 10 and lift out the lower ends 36 of the carrier members 23 in a serial manner or as a unit and then fan out the carrier sheets 23 in the manner illustrated in FIG. 2 to turn over each page 29 to view the same as desired.

Alternately, the person can grasp the framing part 17 and remove the same from the frame construction 10 in the manner illustrated in FIG. 6 to carry all of the carrier members 23 therewith for viewing at a desk or the like in a leisurely manner and then the framing part 17 can be replaced to complete the framing construction 10 as illustrated in FIG. 1 when the viewer has finished viewing the pages 29.

If desired, the carrier member 23 can be formed from a transparent material which will readily take feltpen or the like marking thereon so that a person studying the document sheets 29 can make markings on the carrier members 23 for future reference.

While the frame construction 10 is illustrated as having the upper edges 27 of the carrier members 23 hinged to the framing means 12 while the lower edges 36 thereof are free for fanning out purposes as illustrated in FIG. 2, it is to be understood that the side edges could be hinged if desired so that the fanning out would take place in a manner similar to a book. Also, other means, such as clamps, could be used to hinge the carrier members 23 to the framing means 12.

Another frame construction of this invention is generally indicated by the reference numeral 10A in FIGS. 7–13 and parts thereof similar to the frame construction 10 previously described are indicated by like reference numerals followed by the reference letter A.

Figure 7:
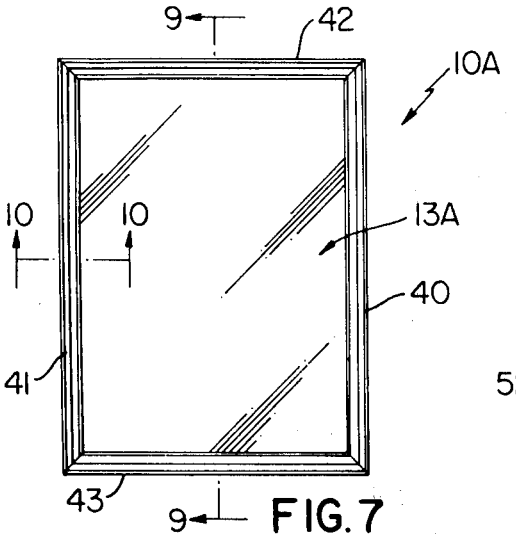
FIG. 7 is a view similar to FIG. 1 and illustrates another embodiment of the improved frame construction of this invention.
Figure 9:
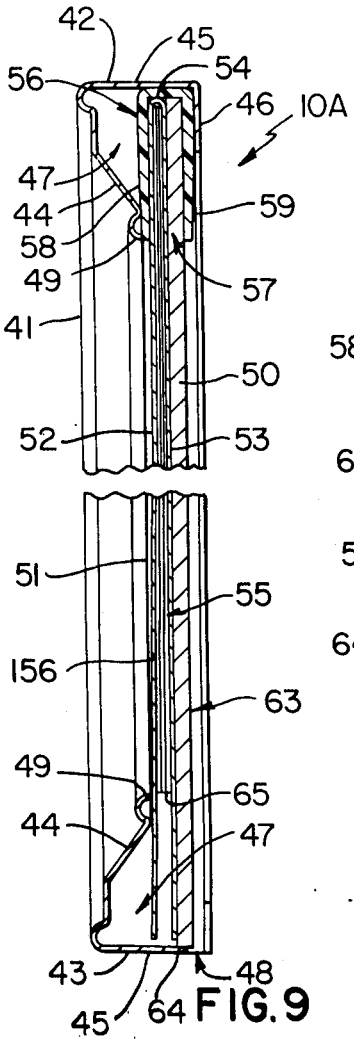
FIG. 9 is an enlarged cross-sectional view taken on line 9—9 of FIG. 7.
Figure 10:
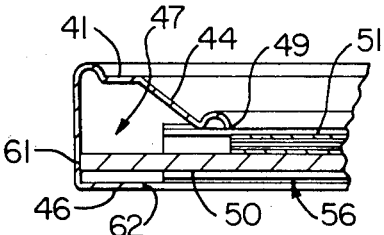
FIG. 10 is an enlarged, fragmentary, cross-sectional view taken on line 10—10 of FIG. 7.

As illustrated in FIGS. 7, 9, and 10,the frame construction 10A comprises a conventional slideback type of picture frame defined by metallic or plastic channel framing parts defining side framing members 40 and 41 interconnected in any suitable manner to top and bottom framing parts 42 and 43, the framing parts 40, 41, 42 and 43 respectively having a decorative stepped front member 44 and an integral edge bordering part 45. The side members 40 and 41 and top part 42 each have a depending integral back part 46 defining a channel 47 therewithin. The bottom part 43 has the back part 46 cut away or not orginally provided to define a slot 48 in the manner illustrated in FIG. 9 wherein a standard backing sheet, glass plate and picture to be framed (not shown) are adapted to be inserted into slot 48 and be received in the channels 47 of the side members 40 and 41 and top member 42 in a conventional manner so that the resulting framed picture will be viewed at the window area 13A defined by the inner peripheral edges 49 of the front parts 44 of the framing members 40, 41, 42, and 43.

However, in order to utilize such conventional framing means 40–45 for a plural page document in a manner taught by this invention, the afore-mentioned glass plate and rectangular backing member is not utilized in combination with each other but the rectangular backing member, such as the rectangular backing member 50 illustrated in the drawings or other like backing member, can be utilized with a folded-over transparent plastic sheet means 51 defining a front transparent sheet 52 and a back transparent sheet 53 hinged together at an integral fold 54 at the upper ends thereof and receiving therebetween the plural page document that is generally indicated by the reference numeral 55 and comprising a plurality of pages 156 either fastened together at the upper edges thereof or remaining loose but disposed in stacked relation with their upper edges inside but adjacent the fold 54 of the transparent sheet means 51.

Figure 12:
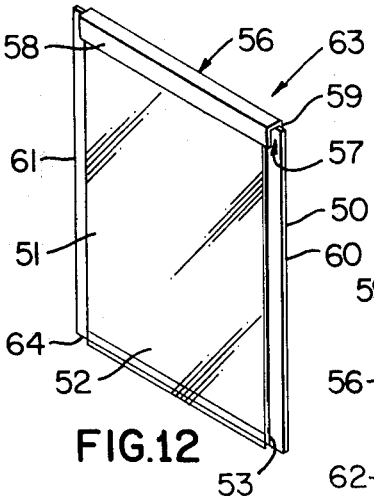
FIG. 12 is a perspective view of a carrier member for the plural page document that is adapted to be inserted in the frame construction of FIG. 7 and be removed therefrom.
Figure 13:
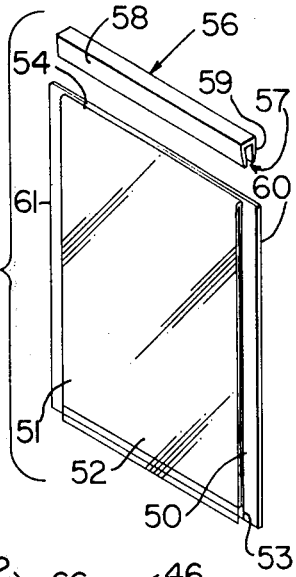
FIG. 13 is an exploded, perspective view of the parts of the carrier means of FIG. 12.

The folded transparent sheet means 51 and the assembled pages 56 are positioned against the backing member 50 in the manner illustrated in FIG. 13 and a plastic clamping channel member 156 receives the upper edges of the transparent sheet 51 and backing member 50 in the channel 57 thereof as illustrated in FIG. 12 wherein the opposed clamping sides 58 and 59 of the clamping member 56 have a natural bias toward each other so that the same firmly holds the arranged folded transparent sheet 51 and backing member 50 together with the inserted pages 56 of the plural page document 55 being held in the stacked configuration illustrated in FIG. 12.

The length of the clamping member 56 is such that the same terminates short of the side edges 60 and 61 of the backing member 50 in the manner illustrated in FIG. 12 and also short of the inner peripheral edges 62, FIG. 10, of the rear parts 46 of the side members 40 and 41 whereby the carrier unit generally indicated by the reference numeral 63 in FIG. 12 can be inserted in the slot 48 in the bottom framing member 43 of the frame construction 10A and be moved upwardly into the position illustrated in FIG. 9 wherein the clamping member 56 is fully received in the channel 47 of the top framing member 42 while the lower edge 64 of the backing member 50 is adapted to be supported on the bordering member 45 of the bottom framing member 43 in the manner illustrated in FIG. 9.

The construction 10A is so sized relative to the pages 156 of the document 55 that when the same are assembled in the carrier unit 63, the transparent pages 52 and 53 of the transparent folded sheet means 51 extend beyond the lower edges 65 of the sheets 156 to be fully received in the channel 47 of the bottom framing member 43 with the lower edges 65 of the sheets 156 being adjacent the inner peripheral edge 40 of the front part 44 of the lower framing 49 43 as illustrated in FIG. 9. In this manner, the front transparent sheet 52 being received in the channel 47 of the lower framing member 43 holds the sheets 156 in stacked relation so as to indicate that a single sheet is appearing at the window area 13A in the manner illustrated in FIG. 7 when the frame construction 10A is mounted on a wall, desk or the like by any suitable fastening means or stand.

Figure 11:
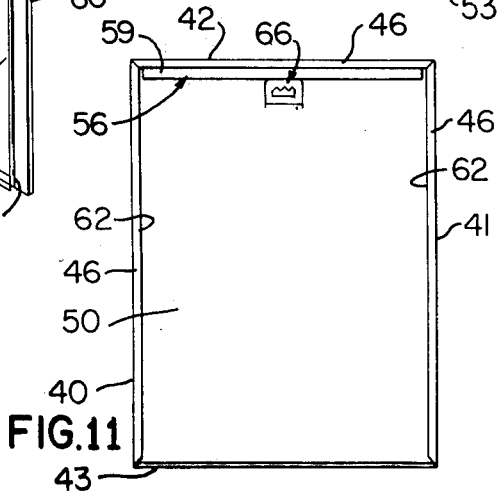
FIG. 11 is a rear view of the frame construction of FIG. 7.

For example, the backing member 50 can have the conventional hanging member 66, FIG. 11, disposed thereon below the back side 59 of the clamping member 56 for mounting the resulting framing construction 10A on a wall or the like and/or can have the conventional leg (not shown) hinged thereto for setting the frame construction on a desk or the like.

Figure 8:
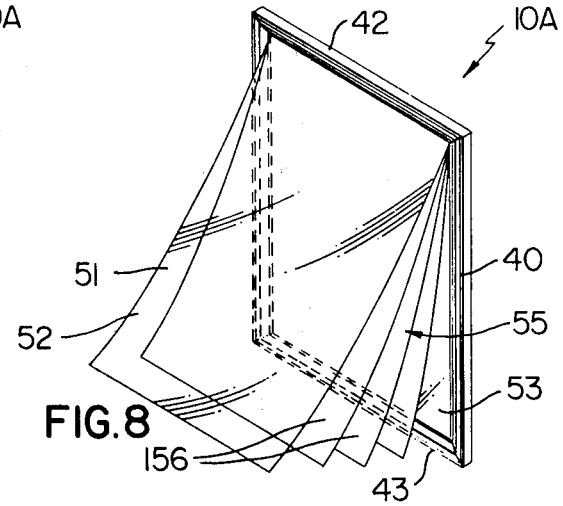
FIG. 8 is a side perspective view of the frame construction of FIG. 7 and illustrates the manner of fanning out the various pages of a plural page document for individual viewing thereof.

However, when it is desired to view the individual pages 156 of the document 55 while the frame construction 10A is disposed on a wall or when removed from the wall and being held at a desk or the like, the user merely removes the lower edge of the front transparent sheet 52 from the channel 47 of the lower framing member 43 and then fans out the sheets 156 in the manner illustrated in FIG. 8 to view the same at his leisure. The sheets 156 can then be moved back into a stacked relation and the lower edge of the front transparent sheet 52 can be reinserted into the channel 47 of the lower frame member 43 in the manner illustrated in FIG. 9 to return the framing construction 19A to the condition illustrated in FIGS. 7 and 9 for display purposes and the like.

Therefore, it can be seen that the frame construction 10A comprises a conventional slide back frame construction utilizing the carrier unit 63 of this invention that permits a plural page document 55 to be inserted therein for top page viewing thereof at the window area 13A with the plural document 59 adapted to be subsequently fanned out in the window area 13A in the manner illustrated in FIG. 8 for individual viewing of the various pages 156 of the document 55.

Another framing construction of this invention for a plural page document is generally indicated by the reference numeral 10B in FIGS. 14–19 and parts thereof similar to the frame construction 10 and 10A previously described are indicated by like reference numerals followed by the reference letter "B".

As illustrated in FIGS. 14, 16 and 17, the frame construction 10B includes a conventional framing means wherein a rectangular channel arrangement, generally indicated by the reference numeral 70, is provided in the rear surface 71 of side frame members 72 and 73 and top and bottom frame members 74 and 75 for normally receiving in stacked relation a rectangular glass cover sheet, a picture to be framed, with or without a mat therefor, and a rectangular backing member, such as backing member 76 illustrated in the drawings, all held within the channel means 70 by suitable fastening means 77 driven parallel to back surface 78 of the back sheet 78 into the framing members 72–75 as illustrated in FIG. 18 whereby the resulting frame construction can be hung from a wall or the like by a suitable hanging member 66B attached to the rear surface of the backing member 76.

Thus, it can be seen that the conventional framing members 72–75 define a window area 13B bordered by the inner peripheral edges 49B thereof, the framing members 72–75 being plane or provided with a decorative cross-section as illustrated in FIGS. 16 and 17.

In order to utilize such a conventional frame 30 structure 10B for displaying a plural page document in the manner of the teachings of this invention, the aforementioned transparent folded sheet means 51B can have the plural page document 55B disposed between the front and back sheets 52B and 53B thereof with the top edges of the individual edges of the pages 156B disposed closely adjacent the top fold 54B of the transparent sheet means 51B. Such arrangement can be held to the backing member 76 by the aforementioned clamping member 56 previously described or can be attached thereto by simple fastening means, such as by staples 79 illustrated in FIG. 19 and passing respectively through the top parts of the front transparent sheet 52B, the pages 156B, back transparent page 53B and backing member 76 to fasten the same altogether into the configuration illustrated in FIG. 19 and providing a carrier unit that is generally indicated by the reference numeral 80 in FIG. 19.

Thereafter, the carrier unit 80 of FIG. 19 can be inserted into the rear channel means 70 of the frame members 72–75 in the manner illustrated in FIGS. 16, 17 and 18 and be secured therein by the fastening members 77 previously described whereby the lower edges of the transparent sheet 52B and 53B are received fully within the channel 70 of the bottom framing member 75 while the lower edges 65B of the pages 156B are disposed closely adjacent the peripheral edge 49B of the bottom framing member 75 in the manner illustrated in FIG. 16 so that the pages can be subsequently fanned outwardly in the manner illustrated in FIG. 15 by removing the lower edge of the front transparent sheet 52B from the channel 70 of the bottom member 75 in the same manner as the frame construction 10A previously described.

Thus, it can be seen that the frame construction 10B readily permits the pages 156B of the plural page document 55B to be individually viewed at the window area 13B thereof and then be moved back into a stacked relation to tend to indicate that only a one page document is being framed by the frame construction 10B.

Another frame construction of this invention is generally indicated by the reference numeral 10C in FIGS. 20–24 and parts thereof similar to the frame constructions 10, 10A and 10B are indicated by like reference numerals followed by the reference letter "C".

Figure 20:
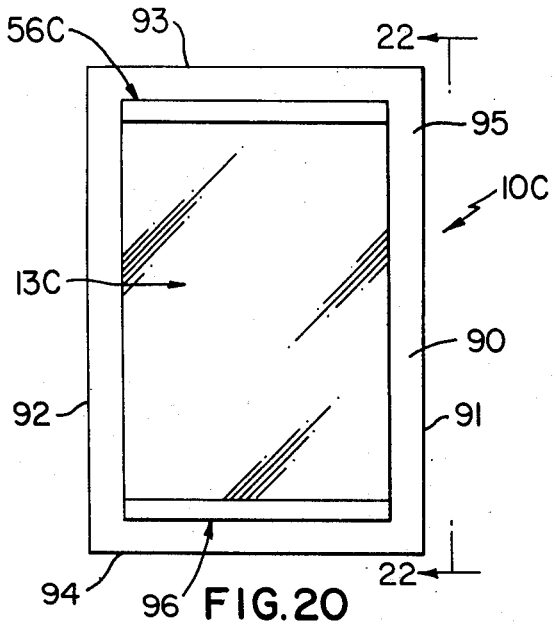
FIG. 20 is a front view of another frame construction of this invention.
Figure 21:
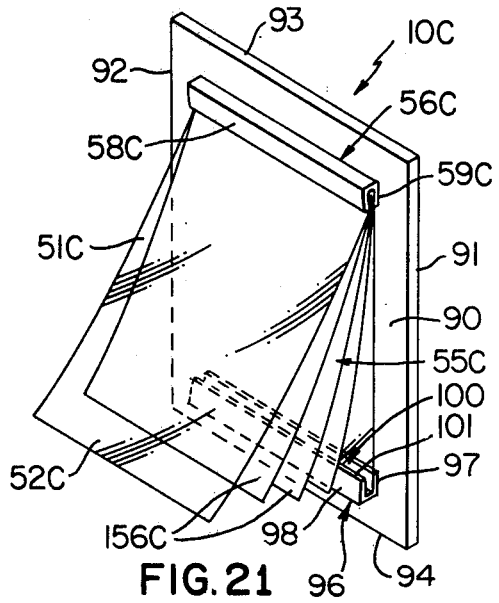
FIG. 21 is a side perspective view of the frame construction of FIG. 20 illustrating the manner of fanning out the various pages of the plural page document thereof for individual viewing thereof.
Figure 22:
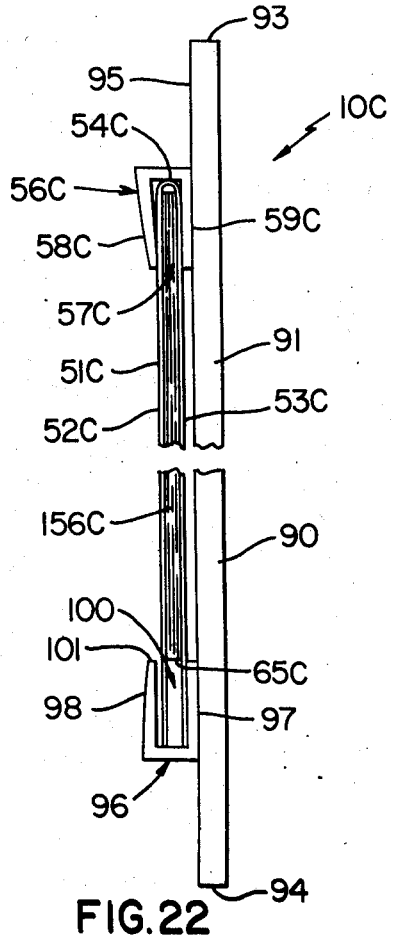
FIG. 22 is an enlarged side view of the frame construction of FIG. 20 and is taken in the direction of the arrows 22—22 of FIG. 20.

As illustrated in FIGS. 20–22, the frame construction 10C includes a substantially flat rectangular plate 90 that defines a substantially rectangular window area 13C inwardly of the lower edges 91 and 92 thereof as well as inwardly of the top and bottom edges 93 and 94 thereof.

A clamping member 56C, similar to the clamping member 56 previously described, has its back side 59C directly fastened to the front surface 95 of the plate 90 parallel to the top edge 93 thereof in the manner illustrated in FIGS. 20–22 to be permanently attached to the backing member 90. For example, such side 59C of the clamping member 56C can be adhesively fastened to the front surface 95 of the plate 90.

A similar channel member 96 has its rear flange 97 directly secured to the front surface 95 of the plate 90 parallel and adjacent to the bottom edge 34 thereof as illustrated in the drawings, the channel member 96 having its front flange 98 not normally biased toward the back flange 97 in the manner illustrated in FIG. 22 so the same normally assumes the open channel condition illustrated in FIG. 22.

Figure 23:
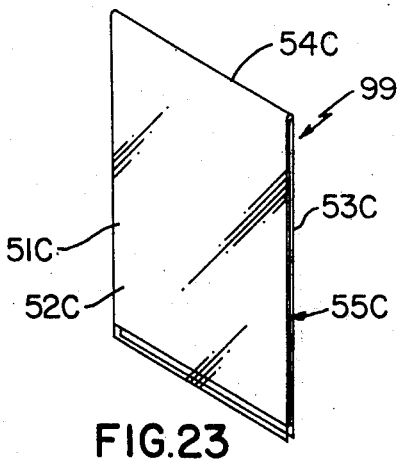
FIG. 23 is a perspective view of the carrier member and a plural page document adapted to be utilized with the frame construction of FIG. 20 as well as readily removed therefrom.

The aforementioned folded transparent sheet 51C is utilized with the plural page document 55C so as to hold the individual stacked pages 155C of the plural page document 55C between the front sheet 52C and back sheet 53C thereof in the manner illustrated in FIG. 23 with the upper edge of the pages 56C being disposed closely adjacent the fold 54C of the transparent sheet means 51C to provide a carrier unit that is generally indicated by the reference numeral 99 in FIG. 23.

Figure 24:
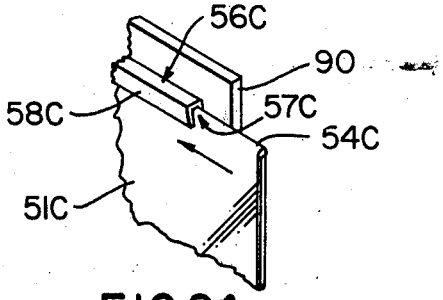
FIG. 24 is a fragmentary, perspective view of the frame construction of FIG. 20 illustrating the manner of inserting the carrier means of FIG. 23 in the frame construction of FIG. 20.

The carrier unit 99 is adapted to be inserted in the channels 56C and 96 of the frame construction 10C by having the fold portion 54C of the transparent sheet 51C inserted within the channel 57C of the upper clamping member 56C in the manner illustrated in FIG. 24 whereby the front flange 58C of the channel member 56C firmly holds the upper portion of the carrier unit 99 in the manner illustrated in FIGS. 20–22 while the lower portion of the sheets 52C and 53C are readily received in the channel 100 of the lower channel member 96 while the lower edges 65C of the pages 156C are disposed closely adjacent the top edge 101 of the front flange 98 of the bottom channel members 96 in the manner illustrated in FIG. 22.

Thus, it can be seen that the carrier member 99 is firmly held in the window area 13C of the frame construction 10C by the upper clamping member 56C and the individual pages 156C can be fanned outwardly in the manner illustrated in FIG. 21 by merely removing the lower portion of the front transparent sheet 52C from the channel 100 of the lower channel member 96 in the manner previously described for individual viewing of the sheets 55C which can be subsequently moved back into stacked condition by reinserting the lower edge of the front transparent sheet 52C in the channel 100 of the lower channel member 96 as illustrated in FIG. 22.

Thus, it can be seen that the carrier means 56C of the frame construction 10C remains part of the same whereas the carrier unit 99 can be readily removed therefrom and a new carrier unit 99 inserted therein in the manner previously described for changing of the plural page document in the frame construction 10C if desired.

Also, it is to be understood that the plate 90 can be formed of wood or other composition as desired and can be hung from a wall in any suitable manner, such as with a wire hanger on the back of the same or by providing an eyelet means extending out of the top edge 33 thereof in a manner similar to a plaque or the like.

It is also to be understood that the channel member 96 can have the channel 100 thereof formed in a relatively shallow manner while still having an overall width similar to the upper clamping member 56C.

Figure 25:
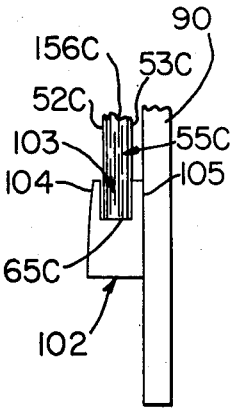
FIG. 25 is an enlarged fragmentary view similar to FIG. 22 illustrating the side of another embodiment of a frame construction of this invention that is similar to the frame construction of FIG. 20.

For example, such a lower channel member is indicated by the reference numeral 102 in FIG. 25 and has a relatively shallow channel 103 formed between the front and back flanges 104 and 105 thereof so that the lower edges 65C of the pages 156C of the plural page document 55C will be readily received in the same along with the lower portions of the front and back transparent sheets 52C and 53C while still permitting all of the same to be readily removed from the shallow channel 103 for fanning out of the same for viewing of the individual page 156C in the manner previously described.

It is to be understood that in all of the frame constructions of this invention, the dimensions of the various parts thereof could be chosen to most complimentary to the particular size and shape of the plural page document being framed thereby. For example, a soft copy of an issued United States patent or issued foreign patent could be the particular plural page document being framed whereby the frame construction of this invention will permit such patent copy to have all the pages thereof readily reviewed when desired so that the same could be a working patent copy as well as a recognition or award copy displaying the inventor's creativity for others to appreciate.

While the forms of the invention now preferred have been disclosed and described by the Patent Statutes, other forms may be utilized and still come within the scope of the appended claims.

What is claimed is:

1. A method of framing a plural page document having a plurality of pages arranged in a serial manner and having data thereon that is normally viewed in said serial manner for said data to make reasonable sense comprising the steps of forming a frame with an open area therewithin, and framing said plural page document in said frame opening so that it appears that the first page of said document is the only page being framed at said open area of said frame but permitting all of said pages of said document to be manually fanned out through said open area to be serially viewed while still being carried by said frame so that said pages can be subsequently unfanned back into said open area in order for said first page to again appear to be the only page being framed by said frame.

2. A method as set forth in claim 1 wherein said step of framing comprises the step of hinging said pages along one side thereof so that said hinged pages are in booklet form.

3. A method as set forth in claim 1 wherein said data of said plural page document normally would be the subject matter for a book of conventional form.

4. A method as set forth in claim 1 wherein said data of said plural page document normally would be the subject matter of a printed patent copy.

5. A method as set forth in claim 1 wherein said plural page document comprises a printed patent copy.

6. A method as set forth in claim 1 wherein said step of forming said frame comprises the step of providing a conventional picture frame.

7. A method as set forth in claim 1 wherein said step of forming said frame comprises the step of forming said frame to have a generally conventional configuration.

8. A method as set forth in claim 1 and including the step of covering the outermost page of said document with a flexible transparent sheet.

9. A method as set forth in claim 8 and including the step of locking all of said pages in an unfanned relation in said open area of said frame with said transparent sheet.

10. A method as set forth in claim 9 wherein said step of locking comprises the step of inserting one edge of said transparent sheet into a slot of said frame.

* * * * *